US005177521A

United States Patent [19]

Mogi et al.

[11] Patent Number: 5,177,521

[45] Date of Patent: Jan. 5, 1993

[54] METHOD FOR ADDING WATER FOR USE IN AN APPARATUS FOR TREATING A PHOTOSENSITIVE MATERIAL

[75] Inventors: Fumio Mogi; Yoshihiro Fujita, both of Kanagawa, Japan

[73] Assignee: Fuji Photo Film Co., Ltd., Kanagawa, Japan

[21] Appl. No.: 686,082

[22] Filed: Apr. 16, 1991

[30] Foreign Application Priority Data

Apr. 19, 1990 [JP] Japan ..... 2-103894

[51] Int. Cl.[5] ..... G03D 13/00; G03D 3/02

[52] U.S. Cl. ..... 354/298; 354/299; 354/324

[58] Field of Search ..... 354/299, 322, 323, 324, 354/298, 320, 317, 319

[56] References Cited

U.S. PATENT DOCUMENTS 4,882,246 11/1989 Ohba et al. ..... 354/299 X
4,937,608 6/1990 Ishikawa et al. ..... 354/324

FOREIGN PATENT DOCUMENTS 1-254959 10/1989 Japan .
1-254960 10/1989 Japan .
1-281446 11/1989 Japan .

*Primary Examiner*—Michael L. Gellner
*Assistant Examiner*—D. Rutledge
*Attorney, Agent, or Firm*—Sughrue, Mion, Zinn, Macpeak & Seas

[57] ABSTRACT

The present invention relates to a method of compensating water for an apparatus for treating a photosensitive material to hold constant the concentration of treating solutions each stored within a plurality of treating tanks. An evaporation loss from the treating tank per unit of time according to its working condition and the environmental data corresponding to the environmental condition of each treating tank are previously evaluated and the environmental conditions prevailing at the place where the apparatus is provided and the working condition of the apparatus are determined. An amount of water to be compensated is calculated for each treating tank based on the evaporation loss per unit of time corresponding to the determined working condition and the environmental data and working condition time according to the determined environmental conditions.

13 Claims, 8 Drawing Sheets

METHOD FOR ADDING WATER FOR USE IN AN APPARATUS FOR TREATING A PHOTOSENSITIVE MATERIAL

BACKGROUND OF THE INVENTION a) Field of the Invention

The present invention relates to a method for compensating water for use in an apparatus for treating a photosensitive material, which is adapted to hold constant the concentration of the treatment solution stored within the tanks thereof.

b) Description of the Related Art

In an automatic developing apparatus, which forms part of the apparatus for treating a photosensitive material, a developing tank, bleaching tank, fixing tank, rinsing tank and a stabilizing tank, for example, are each provided, within each tank a developing solution, bleaching solution, fixing solution, rinsing water and a stabilizing solution (hereinafter referred to generally as a treatment solution) are respectively stored. The photosensitive materials, which have been subjected to a stoving treatment, are each sequentially immersed into each treating tank and, after being developed therein, are led to a drying apparatus for drying prior to being withdrawn.

Since the treating solutions are replenished depending on the amount of photosensitive material to be treated, they are to be maintained in a constant composition. However, since there is a decrease of the treating solution due to the evaporation loss of the water contained therein, the treating solution concentration changes thereby deteriorating treatment performance. Therefore, in order to maintain the original concentration of the treating solution, independently of the replenishing solution, it is necessary to compensate the amount of water which evaporates. However, the evaporation loss differs depending on the surrounding environment that is, the humidity and temperature, and also differences depending on whether the apparatus is in operation or not. Therefore, the amount of compensation cannot be definitely determined by calculation.

In view of this, it has been proposed to attach a liquid level sensor such as a float within the treating solution of each treatment tank and to compensate the water based on a value detected by this sensor (See, for example, Japanese Patent Application Publication No. 1-281446), in which the varying concentration of the treating solution can be detected by the liquid level sensor to compensate an appropriate amount of water.

However, since the liquid level sensor is low in reliability and often operates erroneously, it is often impossible to compensate the proper amount of water. This can also be said of a concentration sensor (gravimeter or the like). In addition, these level and concentration sensors are costly and impractical for use. Thus it is proposed to provide a monitoring treatment tank independent from the treatment tanks which are actually used. This monitoring treatment tank compensates water into the treatment tanks based on the amount of evaporation loss (See Japanese Patent Application Publication Nos. 1-254959 and 1-254960). Accordingly, actual evaporation loss and similar data can be obtained thereby improving operational reliability.

However, in the above-described water compensating system, since the monitoring treatment tank is independent from the actual treatment tanks, the entire apparatus becomes bulky. The number of parts required is also increased. In addition, management and maintenance of the monitoring tank become too complicated to achieve a similar working condition for the actual treatment tanks.

SUMMARY OF THE INVENTION

In view of the above-described circumstances, an object of the present invention is to provide a water compensation method for a photosensitive material treatment apparatus, which eliminates all means for directly detecting evaporation loss from the apparatus yet reliably supplies an appropriate amount of water while at the same time improving the manageability and maintenance of the apparatus.

The present invention relates to a method of compensating water used in the apparatus for treating photosensitive material, in which the evaporation loss of the treating solution from the treating tank is compensated with water to keep the concentration of the treating solution constant, characterized in that the evaporation loss from the treating tank per unit of time is previously evaluated depending on the environmental conditions at the position where the apparatus is positioned, to determine an amount of water to be compensated into the treating tank, based on the previously evaluated evaporation loss and the determined environmental conditions so that an amount of water corresponding to the determined amount may be supplied to the treating tank. The environmental conditions, according to the invention, may be either manually entered or values measured by a thermometer and hygrometer may be used.

According to the above-described arrangement, the evaporation loss from the treating tank per unit of time may be previously evaluated depending on the environmental conditions to determine the environmental conditions at the place where the apparatus is positioned to determine an amount of water to be compensated into the treating tank based on the former and the latter so that the evaporation loss from the treating tank can precisely be predicted. Consequently, the concentration of the treating solution can be held approximately constant and a stable developing operation can be thereby achieved. As a result, it becomes unnecessary to provide a means for determining the evaporation loss of the apparatus itself, resulting in a compact apparatus. In addition, since there is no need to provide a level sensor such as a float or the like for the treating tank or provide a hygrometer for actually measuring the concentration of the treating solution, the chance of an inappropriate amount of water being added through error in detection caused by a faulty level sensor or concentration sensor can also be avoided.

Further, the present invention is a method of holding constant the concentration of the treating solution by compensating the evaporation loss from the treating tank, in which the treating solution for treating the photosensitive material is stored, characterized in that the evaporation loss from the treating tank per unit of time is previously evaluated, depending on the working conditions, to determine an amount of water to be compensated into the treating tank based on the working conditions and working condition time to determine the determined evaporation loss per unit of time and the working condition time so that a water amount corresponding to the determined amount may be supplied to the treating tank.

According to the above-described arrangement, evaporation loss from the treating tank per unit of time is previously evaluated for the working conditions and the working condition time of the apparatus to evaluate the amount of water to be compensated into the treating tank, based on the determined evaporation loss and the working condition time of the apparatus, with the result that when compared to the case where a predetermined amount of water is compensated, a more appropriate amount of water can be compensated because evaporation loss per unit of time, which may differ depending on the working conditions, can be previously set.

In addition, the present invention is a method of holding the concentration of the treating solution constant by compensating the evaporation loss from the treating tank, within which the treating solution for treating the photosensitive material is stored, comprising the steps of:

previously evaluating evaporation loss per unit of time from the treating tank and a correction factor for correcting the amount of water to be compensated depending on the working conditions of the apparatus;

determining the environmental conditions at the place where the apparatus is positioned, working conditions and working time of the apparatus;

determining an amount of water to be compensated into the treating tank based on the determined evaporation loss, correction factor and the working condition time of the apparatus; and supplying a water amount corresponding to the evaluated amount into the treating tank.

In the present invention, the values representing the above-mentioned environmental conditions may be either manually entered or obtained by measurements using a thermometer or hygrometer.

According to the above-described arrangment, the evaporation loss from the treating tank per unit of time, which varies with the working conditions of the apparatus, and the correction factor for correcting the amount of water to be compensated, which varies with the environmental conditions prevailing at the place where the apparatus is provided, are previously evaluated to determine the environmental conditions, working conditions and the working condition time of the apparatus to determine an amount of water to be compensated into the treating tank based on the determined evaporation loss, correction factor and working conditions with the result that the amount of water to be compensated can be further approximated to the actual evaporation loss.

The above-described working conditions can be classified into three types: a running condition, a stand-by condition and a shut down condition by way of example.

The above-stated running condition refers to one in which a fan heater for a drying unit of the apparatus is operating and the photsensitive material is being conveyed into the treating tank or is in a state allowing treatment thereof. Further, the stand-by condition refers to a state, in which, for example, the fan heater is stopped and the temperature of the treating solution is being adjusted, but the photosensitive material is not being conveyed into the treating tank. The shutdown condition refers to a state in which, for example, a main switch of the apparatus is turned off.

In addition, the above-described correction factor can be set to three types: one for a standard condition, one for a low humidity condition which is lower than in the standard condition, and one for a high humidity condition which is higher than in the standard condition.

As described above, according to the present method of compensating water, the equipment for detecting the evaporation loss becomes unnecessary for the apparatus itself and an appropriate amount of water can be supplied thereto with high reliability while its manageability and maintenance can be significantly improved.

DETAILED DESCRIPTION OF THE PREFERRED EMBODIMENTS

Figure 1:
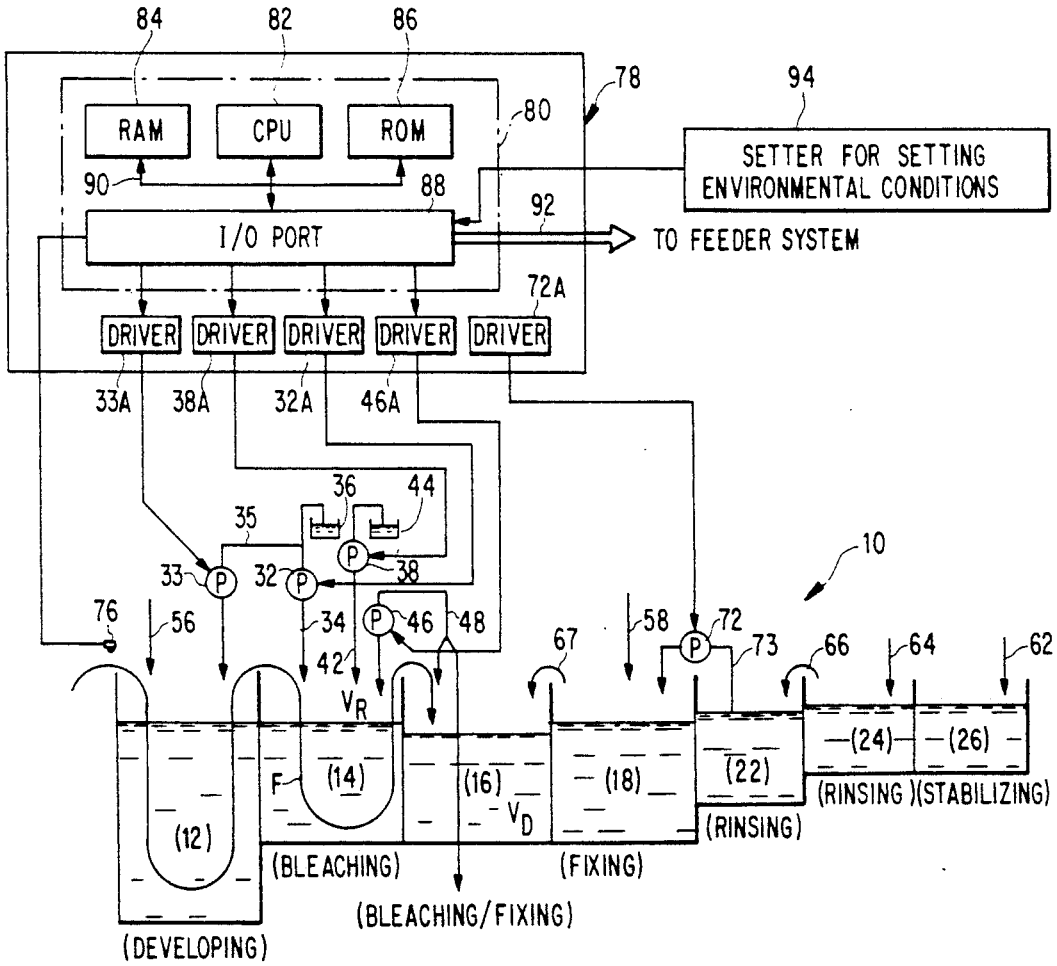
FIG. 1 is a schematic cross-sectional view illustrating an automatic developing apparatus according to a first embodiment of the invention.

In FIG. 1, an automatic developing apparatus according to the first embodiment is illustrated which may act as an apparatus for treating the photo sensitive material embodying the present invention, in which a developing tank (N1)12, a bleaching tank (N2)14, a bleaching-/fixing tank (N3-1)16, a fixing tank (N3-2)18, rinsing tanks (NS-1, NS-2) 22, 24, and a stabilizing tank (NN4) 26 are provided in series each storing a developing solution, bleaching solution, bleaching/fixing solution, rinsing solution and a stabilizing solution in predetermined amounts so that a photosensitive material F can be sequentially conveyed into these treating tanks by a converyer system (not shown). (hereinafter referred to generally as a treating tank 10) The conveyer system is controlled by a control unit 78. Connected to this control unit 78 is a signal line of a sensor 76 provided at the inlet of the developing tank 12 for sensing the passage of the photosensitive material F thereby determining whether the photosensitive material F is present or not.

As shown in FIG. 1, disposed adjacent to the treating tank 10 is a water tank 36, which communicates with the bleaching tank 14 via a line 34. Interposed at an intermediate portion of the line 34 is a pump 32 which is controlled and driven by a control unit 78 so that by driving this pump 32 water is supplied to the bleaching tank 14. In addition, disposed adjacent to the water tank 36 is a replenishing solution tank 44 which is in communication with the bleaching tank via a line 42. Interposed at an intermediate portion of this line 42 is a pump 38 which is driven and controlled by the control unit 78 so that, as in the above-described rinsing tank, the bleaching replenishing solution may be replenished into the bleaching tank 14 by driving the pump 38.

Incidentally, at the line 34, which replenishes water into the bleaching tank, a branch line 35 is provided upstream from the pump 32. This branch line 35 extends into the developing tank 12. Interposed at an intermediate portion of the branch line 35 is a pump 33, which is driven and controlled by the control unit 78, so that by driving the pump 33 water is supplied into the developing tank 12.

At the developing tank 12, fixing tank 18, and stabilizing tank 26, which are the treating tanks other than the above-described bleaching tank 14, lines 56, 58 and 62 are each provided for supplying the replenished treating solution. In addition, a water supply line 64 is disposed extending toward the rinsing tank 24 to replenish the rising water. The rinsing water is fed from the rinsing tank 24 to the rinsing tank 22 through an overflow 66 while the fixing solution is fed from the fixing tank 18 to the bleaching/fixing tank 16 through an overflow 67. The rinsing water of the rinsing tank 22 is arranged to be fed to the fixing tank 18 by pumps 72 and line 73. Consequently, in this embodiment, in order to overflow, water is supplied to the rinsing tank 24 so that it may also be compensated to the bleaching/fixing tank 16, fixing tank 18 and rinsing tanks 22 and 24. Incidentally, the driving of these pumps is also controlled by the above-described control unit 78.

As shown in FIG. 1, the control unit 78 is arranged to include a microcomputer 80, which comprises a CPU 82, RAM 84, ROM 86, I/O (input/output) port 88, a data bus for connecting these or a bus such as a control bus and the like. Connected to the I/O port 88 are the above-described pumps 32, 33, 46 and 72 through drivers 32A, 33A, 38A, 46A and 72A. In addition, connected to this I/O port 88 are a sensor 76 and a setter 94 for setting the environmental conditions. Still further, also connected to this I/O port 88 is a signal line 92 with leads to the conveyer system.

Stored in the ROM 86 of the microcomputer 80 are data representing the conditions on the amount of water to be compensated for the present automatic developing unit under each working condition, the data being intended for correcting the evaporation loss as shown in Table 1. This evaporation correction data includes data for setting the evaporating speed under each working condition, the correction factor and the corrected amount under each environmental condition in accordance with data obtained by measuring the evaporating speed for each treating tank 10 under each condition (stand-by condition, running condition and shutdown condition) as well as five types of environmental conditions (See Table 2, (a)) and by measuring an all day working condition under each environmental condition six types of combinations can be contemplated (See Table 2 (b)).

Incidentally, the evaporating speed and the correction value for working condition is each determined for the developing tank 12, bleaching tank 14, rinsing tank 24 and the stabilizing tank 26. However, concerning the evaporating speed and the correction value for the rinsing tank 24, they are defined to correspond to a sum of the values for the bleaching/fixing tank 16, fixing tank 18 and rinsing tanks 22 and 24.

TABLE 1

| | VS (ml/h) | VD (ml/h) | VO (ml/h) | f0 | f1 | f2 | α (ml) |
|---|---|---|---|---|---|---|---|
| N1 | 12.2 | 18.0 | 6.0 | 1.0 | 1.2 | 0.8 | 40 |
| N2 | 7.2 | 15.0 | 3.5 | 1.0 | 1.2 | 0.8 | 40 |
| NS | 29.9 | 55.5 | 11.6 | 1.0 | 1.2 | 0.8 | 120 |
| N4 | 11.7 | 31.6 | 3.3 | 1.0 | 1.2 | 0.8 | 30 |

VS: evaporating speed in a stand-by condition
VD: evaporating speed in a running condition
VO: evaporating speed in a shutdown condition
f0: correction factor in a standard condition
f1: correction factor in a low humidity (dry) condition
f2: correction factor in a high humidity condition
N1: developing tank
N2: bleaching tank
N3: rinsing tank
N4: stabilizing tank
α: corrected amount (for correction of the rinsing water)

TABLE 2(a)

| type | environmental condition | evaporating speed STANDBY (ml/h) | DRIVE (ml/h) | NIGHT (ml/h) |
|---|---|---|---|---|
| N1 | 32° C./80% | 11.4 | 12.2 | 4.9 |
| | 32° C./20% | 11.1 | 18 | 6.3 |
| | 25° C./35% | 12.2 | 18.7 | 6.3 |
| | 15° C./65% | 12.3 | 17.1 | 6.7 |
| | 15° C./20% | 12.8 | 23.9 | 7.3 |
| N2 | 32° C./80% | 6.4 | 9.1 | 2.3 |
| | 32° C./20% | 6.1 | 15 | 3.7 |
| | 25° C./35% | 7.2 | 15.7 | 3.8 |
| | 15° C./65% | 7.34 | 14.1 | 4.2 |
| | 15° C./20% | 7.8 | 20.9 | 4.8 |
| N3-1 | 32° C./80% | 4.5 | 2 | 1.3 |
| | 32° C./20% | 4.3 | 5.4 | 2.6 |
| | 25° C./35% | 5.3 | 6.1 | 2.7 |
| | 15° C./65% | 5.5 | 4.5 | 3.1 |
| | 15° C./20% | 5.9 | 11.3 | 3.7 |
| N3-2 | 32° C./80% | 4.5 | 2.9 | 1 |
| | 32° C./20% | 4.2 | 8.7 | 2.3 |
| | 25° C./35% | 5.2 | 9.4 | 2.4 |
| | 15° C./65% | 5.4 | 7.8 | 2.8 |
| | 15° C./20% | 5.8 | 14.6 | 3.4 |
| NS-1 | 32° C./80% | 5.9 | 5.5 | 1.6 |
| | 32° C./20% | 5.7 | 11.4 | 3 |
| | 25° C./35% | 6.7 | 29.3 | 4.3 |
| | 15° C./65% | 6.9 | 10.5 | 3.4 |
| | 15° C./20% | 7.3 | 17.3 | 4.1 |
| NS-2 | 32° C./80% | 12.2 | 22.8 | 2.9 |
| | 32° C./20% | 11.9 | 28.7 | 4.3 |
| | 25° C./35% | 13 | 29.3 | 4.3 |
| | 15° C./65% | 13.1 | 27.7 | 4.7 |
| | 15° C./20% | 13.6 | 34.6 | 5.3 |
| N4 | 32° C./80% | 11.1 | 25.7 | 2.1 |
| | 32° C./20% | 10.8 | 31.6 | 3.5 |
| | 25° C./35% | 11.8 | 32.3 | 3.5 |
| | 15° C./65% | 12 | 30.7 | 3.9 |
| | 15° C./20% | 12.4 | 37.5 | 4.5 |

N1: developing tank
N2: bleaching tank
N3-1: fixing tank
N3-2: fixing tank
NS-1: rinsing tank
NS-2: rinsing tank
N4: stabilizing tank
STANDBY (S): stand-by condition
DRIVE (D): running condition
NIGHT (N): shutdown condition TABLE 2(b)

| type | environmental condition | one day evaporating loss (ml/day) 7S + 1D + 16N | 9S + 1D + 14N | 11S + 1D + 12N | 4S + 4D + 16N | 6S + 4D + 14N | 8S + 4D + 12N |
|---|---|---|---|---|---|---|---|
| N1 | 32° C./80% | 170.4 | 183.4 | 196.4 | 172.8 | 185.8 | 198.8 |
| | 32° C./20% | 196.5 | 206.1 | 215.7 | 217.2 | 226.8 | 236.4 |
| | 25° C./35% | 204.9 | 216.7 | 228.5 | 224.4 | 236.2 | 248 |

TABLE 2(b)-continued

| type | environmental condition | one day evaporating loss (ml/day) | | | | | |
|---|---|---|---|---|---|---|---|
| | | 7S + 1D + 16N | 9S + 1D + 14N | 11S + 1D + 12N | 4S + 4D + 16N | 6S + 4D + 14N | 8S + 4D + 12N |
| | 15° C./65% | 210.4 | 221.6 | 232.8 | 224.8 | 236 | 247.2 |
| | 15° C./20% | 230.3 | 241.3 | 252.3 | 263.6 | 274.6 | 285.6 |
| N2 | 32° C./80% | 90.7 | 98.9 | 107.1 | 98.8 | 107 | 115.2 |
| | 32° C./20% | 116.9 | 121.7 | 126.5 | 143.6 | 148.4 | 153.2 |
| | 25° C./35% | 126.9 | 133.7 | 140.5 | 152.4 | 159.2 | 166 |
| | 15° C./65% | 132.68 | 138.96 | 145.24 | 152.96 | 159.24 | 165.52 |
| | 15° C./20% | 152.3 | 158.3 | 164.3 | 191.6 | 197.6 | 203.6 |
| N3-1 | 32° C./80% | 54.3 | 60.7 | 67.1 | 46.8 | 53.2 | 59.6 |
| | 32° C./20% | 77.1 | 80.5 | 83.9 | 80.4 | 83.8 | 87.2 |
| | 25° C./35% | 86.4 | 91.6 | 96.8 | 88.8 | 94 | 99.2 |
| | 15° C./65% | 92.6 | 97.4 | 102.2 | 89.6 | 94.4 | 99.2 |
| | 15° C./20% | 111.8 | 116.2 | 120.6 | 128 | 132.4 | 136.8 |
| N3-2 | 32° C./80% | 50.4 | 57.4 | 64.4 | 45.6 | 52.6 | 59.6 |
| | 32° C./20% | 74.9 | 78.7 | 82.5 | 88.4 | 92.2 | 96 |
| | 25° C./35% | 84.2 | 89.8 | 95.4 | 96.8 | 102.4 | 108 |
| | 15° C./65% | 90.4 | 95.6 | 100.8 | 97.6 | 102.8 | 108 |
| | 15° C./20% | 109.6 | 114.4 | 119.2 | 136 | 140.8 | 145.6 |
| NS-1 | 32° C./80% | 72.4 | 81 | 89.6 | 71.2 | 79.8 | 88.4 |
| | 32° C./20% | 99.3 | 104.7 | 110.1 | 116.4 | 121.8 | 127.2 |
| | 25° C./35% | 145 | 149.8 | 154.6 | 212.8 | 217.6 | 222.4 |
| | 15° C./65% | 113.2 | 120.2 | 127.2 | 124 | 131 | 138 |
| | 15° C./20% | 134 | 140.4 | 146.8 | 164 | 170.4 | 176.8 |
| NS-2 | 32° C./80% | 154.6 | 173.2 | 1891.8 | 186.4 | 205 | 223.6 |
| | 32° C./20% | 180.8 | 196 | 211.2 | 231.2 | 246.4 | 261.6 |
| | 25° C./35% | 189.1 | 206.5 | 223.9 | 238 | 255.4 | 272.8 |
| | 15° C./65% | 194.6 | 211.4 | 228.2 | 238.4 | 255.2 | 272 |
| | 15° C./20% | 214.6 | 231.2 | 247.8 | 277.6 | 294.2 | 310.8 |
| N4 | 32° C./80% | 137 | 155 | 173 | 180.8 | 198.8 | 216.8 |
| | 32° C./20% | 163.2 | 177.8 | 192.4 | 225.6 | 240.2 | 254.8 |
| | 25° C./35% | 170.9 | 187.5 | 204.1 | 232.4 | 249 | 265.6 |
| | 15° C./65% | 177.1 | 193.3 | 209.5 | 233.2 | 249.4 | 265.6 |
| | 15° C./20% | 196.3 | 212.1 | 227.9 | 271.6 | 287.4 | 303.2 |

Figure 2:
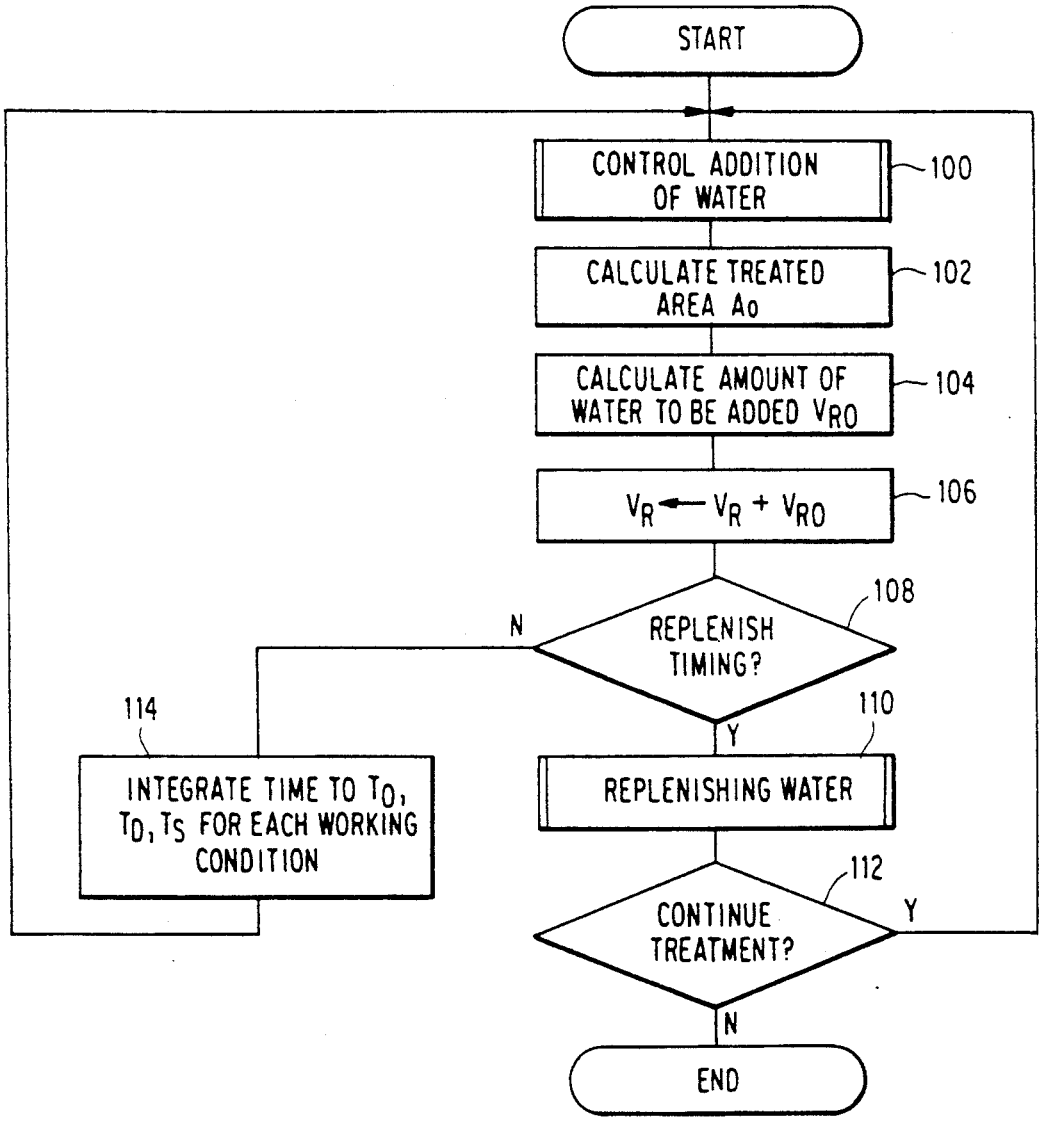
FIG. 2 is a control flowchart illustrating main routines for the first and a second embodiments.
Figure 3:
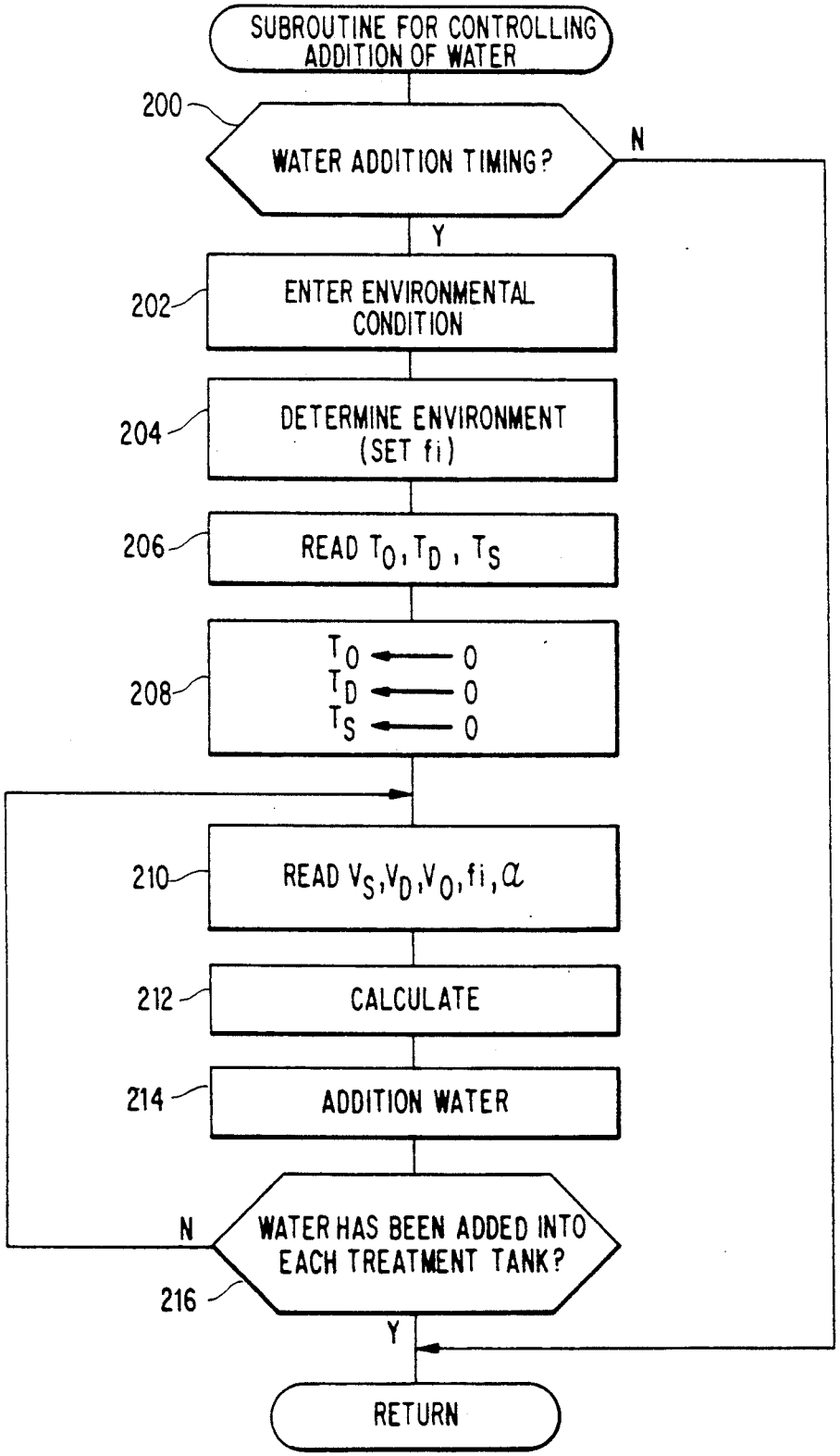
FIG. 3 is a flowchart illustrating a subroutine for controlling the addition of water according to the first embodiment.

N1: developing tank
N2: bleaching tank
N3-1: fixing tank
N3-2: fixing tank
NS-1: rinsing tank
NS-2: rinsing tank
N4: stabilizing tank
STANDBY (S): stand-by condition
DRIVE (D): operating condition
NIGHT (N): shutdown condition In addition, within ROM 86 of the microcomputer 80, a program for replenishing the solution and a program for controlling the addition of water, as shown in FIGS. 2 and 3, are stored. On the other hand, within ROM 86, an arithmetic operation formula (See the following formula) is stored for evaluating the amount of water to be compensated based on the parameters in Table 1, which are assigned to the program of embodiments 1 and 2 for compensating water.

amount of water to be compensated = (1)

$$TS \times VS + (TD \times VD + TO \times VD) \times fi - \alpha$$

where:

TS: stand-by time (hours)
TD: running time (hours)
TO: shutdown time (hours)
VS: evaporating speed in a the stand-by condition (ml/hour)
VD: evaporating speed in a running condition (ml/hour)
VO: evaporating speed in a shutdown condition (ml/hour)
fi: correction factor (i=0, 1, 2)
i=0. . . standard condition
i=1. . . low humidity condition
i=2. . . high humidity condition
α: corrected amount (for correction of the cleaning water)

In this case, concerning the correction factor fi, with 32° C./80% and 15° C./20% (environmental conditions) in Table 2 taken as opposite extreme values, the mean value of the evaporating speeds under the environmental conditions which lie within a range between both those extreme values is defined to be the correction factor 1.0 ($f_0$) in the standard condition. By way of example, the standard condition may be defined to be a temperature of 25° C. and 35% humidity. In addition, the correction factors in both high and low humidity conditions may each be evaluated from a ratio of each evaporating speed to that evaluated from the above-described environmental conditions. At this time, the low humidity condition is defined to assume, for example, a temperature of 20° C. and 20% humidity while the high humidity condition is defined to assume, for example, a temperature of 32° C. and 80% humidity. However, this correction factor varies with fluctuating environmental conditions under which the apparatus is to be provided or the target evaporation correcting level.

Therefore, in this embodiment, as shown in Table 1, although each of the correction factors is defined as $f_1=1.2$ and $f_2=0.8$, they can each assume values within the above-listed range. In other words, since they are evaluated from the ratio of the evaporating speeds obtained from each environmental condition, the fluctuating ranges of the above-described environmental conditions differ from each other and the correction factor is correspondingly altered.

$$1.0 < f_1 \leqq 1.4 \quad (2)$$

$$0.6 < f_2 \leqq 1.0 \quad (3)$$

In addition, on this automatic developing apparatus, water is manually compensated when the operation for the day is ended, to clean the interior thereof. Therefore, in this embodiment, in order to exclude the effect caused by the cleaning water compensated for this cleaning, a value obtained by subtracting the correction value resulting from use of the cleaning solution is assumed to be the amount of water to be compensated.

Next, the operation of this embodiment will be described with reference to the control flowcharts (FIGS. 2 and 3).

The photosensitive material F is sequentially introduced from the developing tank 12 to the bleaching tank 14 and the bleaching/fixing tank 16 to be developed and bleached and is dried after being withdrawn from the stabilizing tank 26.

In step 100, control of the addition of water is conducted, but this will be described later. The control unit 78 calculates a treated surface area $A_O$ of the photoconductive material F within a predetermined period of time and through the detection of sensor 76 and an amount $V_{RO}$ of replenishing water based on the treated surface area $A_O$, which is necessary for recovering the deterioration of the treating solution within each treating tank 10 to integrate this according to the throughput and the area of the photosensitive materials F to be treated for evaluating an integrated value $V_R$ (steps 102, 104 and 106).

If the throughput of the photosensitive material F amounts to 50 sheets, for example, in terms of the negative and the time is determined to be appropriate for replenishing the solution (step 108), then the procedure proceeds to step 110 for replenishing the solution. In the next step 112, it is determined whether the solution should be continuously supplied or not. If yes, then the procedure proceeds to step 100. On the contrary, if it is determined in step 108 that the time is not appropriate for replenishing, then the procedure shifts from step 108 to step 114 where it is determined whether the apparatus is in the running condition, stand-by condition or shutdown condition, and the time taken for that condition is determined to be each integrated into TD, TS and TO prior to moving to step 100.

Incidentally, when it is determined at step 108 that the time is appropriate for replenishing the solution, the time for each working condition is also counted while the solution is being replenished, and when the procedure shifts to step 114, it is accumulated depending on the working condition.

Figure 8:
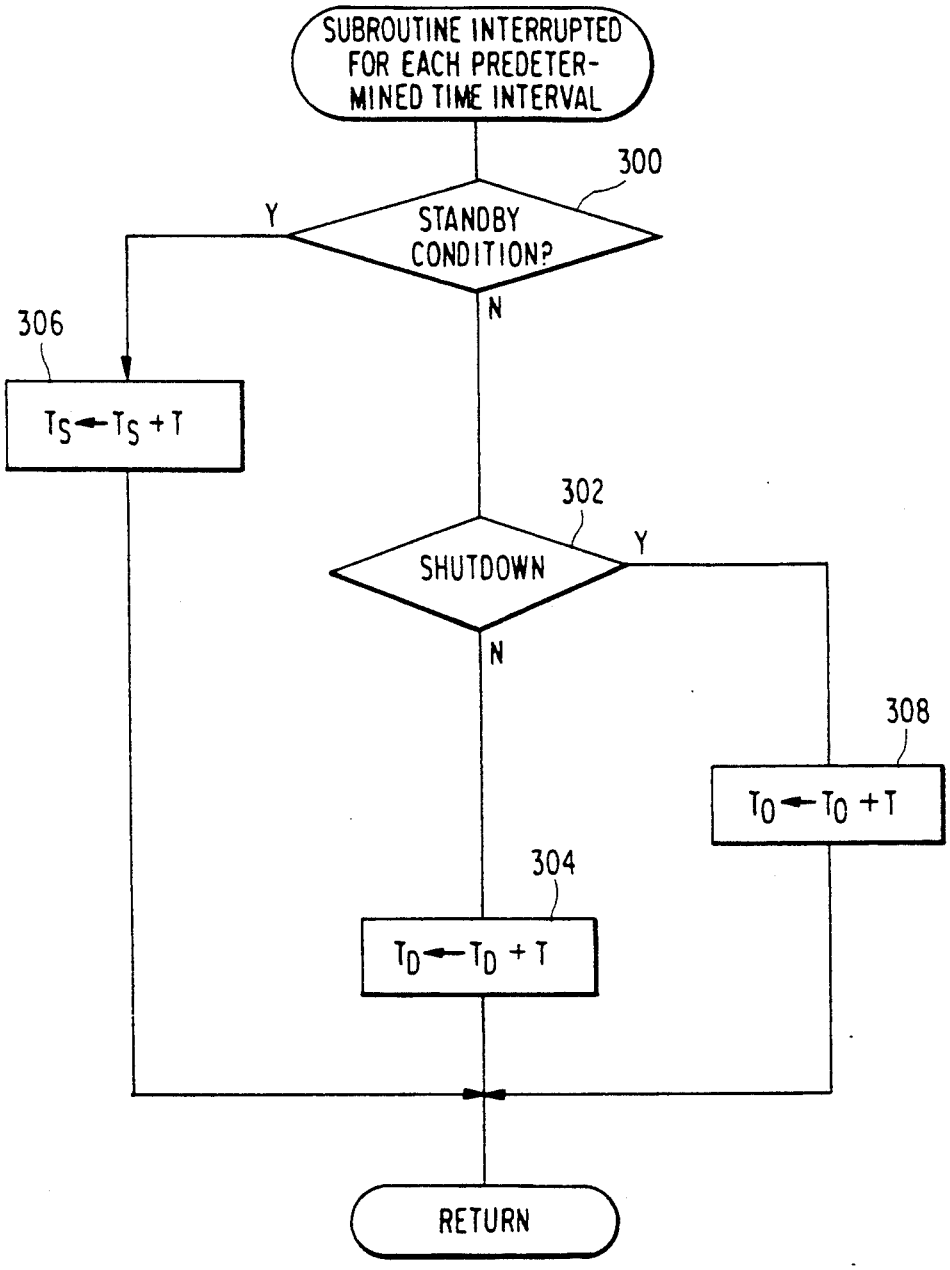
FIG. 8 is an interrupt subroutine used in place of a step 114 in FIG. 2.

In this embodiment, although in step 114 the time for each working condition is integrated, this step may be omitted and, alternatively, as shown in FIG. 8, an interrupt routine may be used to count the time for each working condition every predetermined period of time (for example, 1 min).

In this interrupt routine, it is determined in step 300 whether the working condition is the stand-by condition. If yes, then the stand-by time TS is incremented by one in step 306 to complete this routine. If determined otherwise in step 300, then the procedure proceeds to step 302 where it is determined whether the working condition is in the shutdown condition or not. If yes, then in step 308, the shutdown time TO is incremented by one to end this routine. If determined otherwise in step 302, then, since the system is in the running condition, the procedure 304 enters step 304 where the running time $T_D$ is incremented by one to end the routine.

By repeating such procedures, the deteriorated composition can be recovered.

Next, the subroutine for controlling addition of water in step 100 will be described. As shown in FIG. 3, in step 200, it is determined whether the time is appropriate for compensating water or not. In this embodiment, when the main switch of the power supply for the apparatus is turned on, it is determined to be the time for compensating water. If herein determined otherwise, then the procedure is returned because there is no need to compensate water. In addition, if determined in the affirmative, then the procedure is shifted to step 202, where the environmental condition is manually entered by the setter 94 for setting the environmental condition, and in step 204, it is determined, based on the entered information, which of the standard, low humidity and high humidity conditions it corresponds to, to evaluate the numerical vaue of i for the correction factor fi.

In the next step 206, the values of TD, TS and TO are separately read and, subsequently, in step 208, these variables TD, TS and TO are cleared. In the next step 210, VS, VD and VO and $f_i$ and $\alpha$ in Table 1, which are stored in ROM 86 of the control unit 78, are read out and the procedure moves to step 212 where an arithmetic operation is conducted based on the above-described formula (See the formula (1)). Incidentally, in this step, the amount of water to be compensated is evaluated for the developing tank 12, bleaching tank 14 and the rinsing tanks 24 and 26, depending on the environmental condition and the working condition. As for the amount for the rinsing tank 24, a sum of the amounts for the bleaching/fixing tank 16, fixing tank 18 and rinsing tanks 22 and 24 is evaluated.

Next, in step 214, based on the amount of water to be compensated, which is obtained by calculating, the pump is driven to compensate the water.

This addition of water is conducted for each necessary treating tank (steps 210, 212 and 214 are repeated) and if, in step 216, it is determined that water has been compensated into each treating tank, then the procedure returns to the main routine.

Incidentally, in this embodiment, although the evaporation correction data based on each environmental condition are separately set further for each working condition (running condition, stand-by condition and the shutdown condition) of the automatic developing apparatus, even if the amount of water to be compensated is determined based merely on the time for each working condition of the apparatus, it is possible to properly control the addition of water over a case where a predetermined amount of water is to be compensated.

In addition, although, in this embodiment, the environmental conditions are manually entered, even if the correction factor is derived only according to the distinction between the standard, wet and dry and the like as well as regional or seasonal conditions, it is possible to effectively control the addition of water over by merely compensating the predetermined amount of water.

In addition, although, in this embodiment, the environmental conditions are manually entered, alternatively, the standard environmental condition may be previously stored into ROM 86 so that when, the power supply of the apparatus is turned on, they may be read out for storage into ROM 84 so as to set the environmental conditions. If it is necessary to change the environmental conditions in accordance with this method, the environmental conditions may be manually entered by the setter 94 to rewrite the content of RAM 84. In addition, although, in this embodiment, the environmental conditions are entered each time they are determined that the time is appropriate for compensating water, as described above, it is unnecessary to enter the environmental conditions again because they are already stored into RAM 84. That is, once the environmental conditions are stored into RAM 84, it becomes unnecessary to enter the same prevailing at the place where the apparatus is provided each time the water compensating time falls because the water compensating timing is thereafter controlled based on the environmental conditions stored therein.

Figure 4:
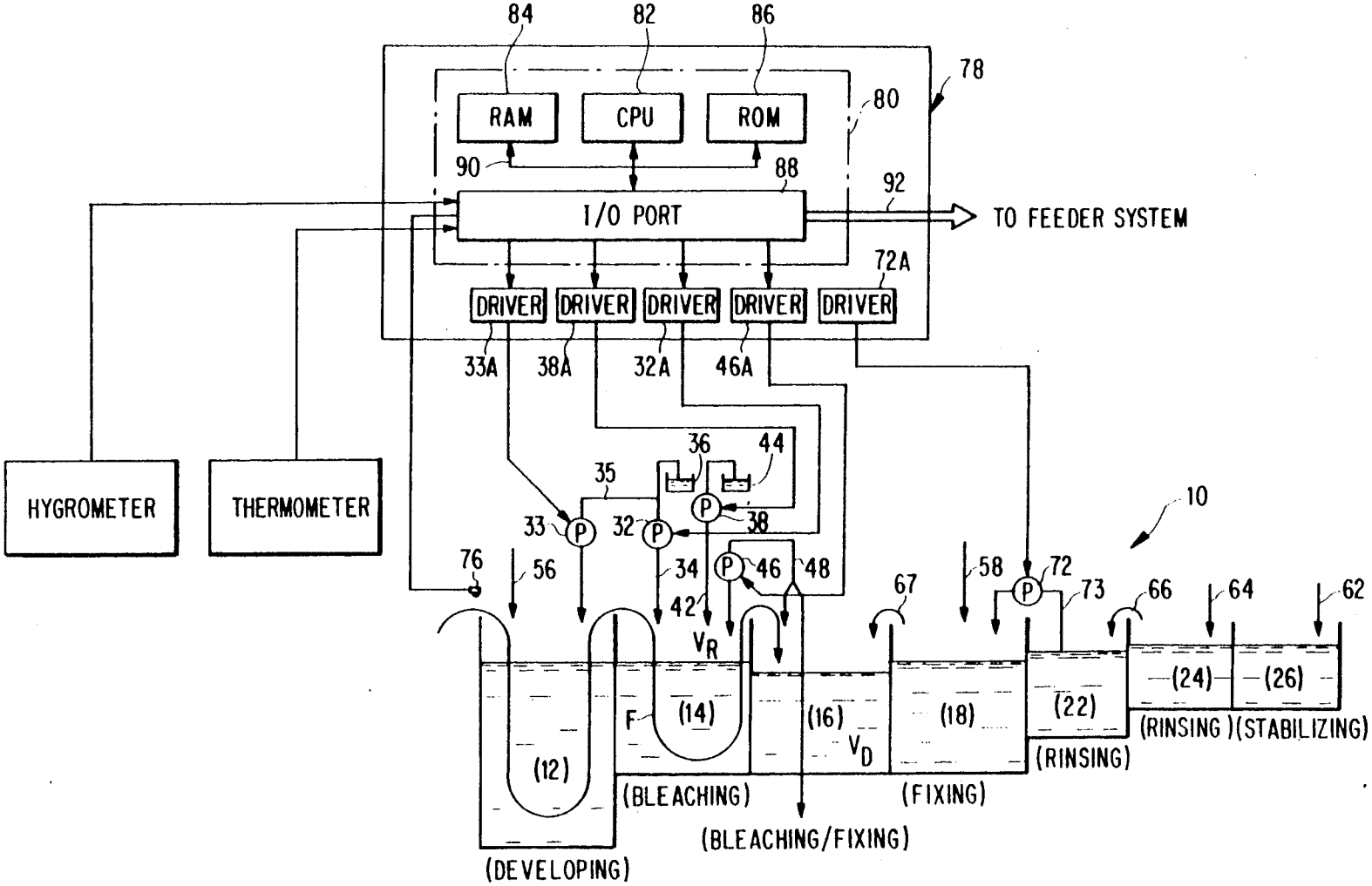
FIG. 4 is a schematic cross-sectional view illustrating an automatic developing apparatus according to the second embodiment.
Figure 5:
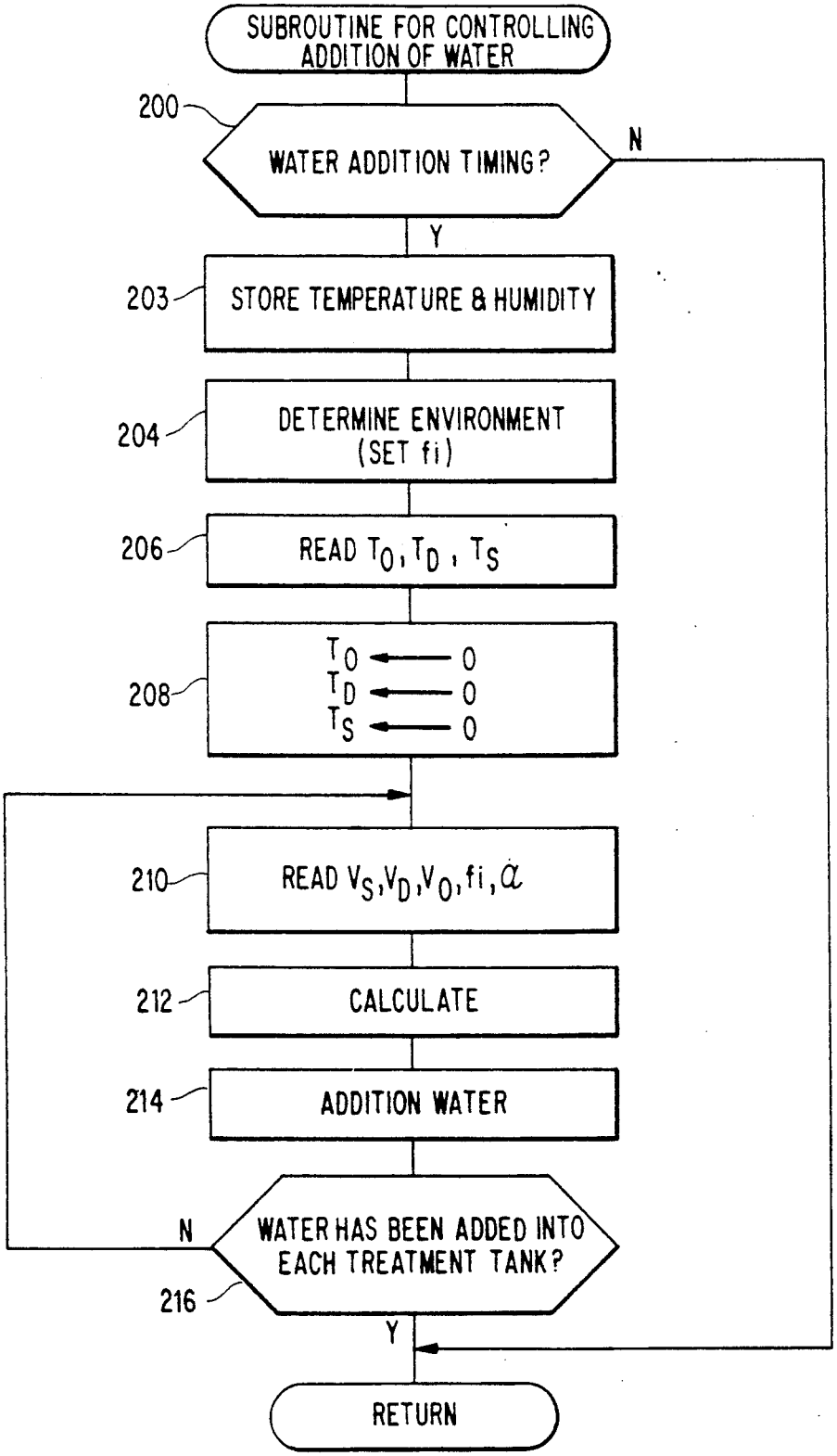
FIG. 5 is a flowchart illustrating a subroutine for controlling the addition of water according to the second embodiment.

In FIG. 4, an automatic developing unit according to a second embodiment, which acts as the apparatus for treating the photosensitive material, is illustrated. In this embodiment, in place of reading the environmental conditions in step 202, which is illustrated in the subroutine of FIG. 3 according to the first embodiment, a step 203 as shown in FIG. 5, in which the temperature and the humidity are read, is used. Therefore, like signs are designated to like portions in FIG. 3 so further description will be omitted. Besides, in this embodiment, in place of the setter 94 shown in the first embodiment, a thermometer 96 and a hygrometer 98 for measuring the environmental conditions surrounding the apparatus is connected to the I/O port 88.

Incidentally, Table 3 shows the results obtained by calculating the amounts of water to be compensated over a day based on the above-described operating formulae and the condition parameters of Table 1, which are needed for correcting the evaporation loss for the apparatuses in the first and second embodiments. When this result and the evaporation loss of Table 2 (b) are compared, it proves that both are approximate and that an effective correction of the evaporation loss can be achieved. In consequence, if the amount of water obtained by calculating according to the present invention is compensated, then an extremely effective addition of water can be achieved by merely compensating a predetermined amount of water for the day with the result that the concentration of the treating solution can be held approximately constant and a stable developing treatment can be realized.

Incidentally, the amounts of water to be compensated, as shown in Table 3, refer to those for the developing tank 12, bleaching tank 14, rinsing tank 24 and the stabilizing tank 26 respectively. The one for the rinsing tank 24 corresponds to the sum of those for the bleaching/fixing tank 16, fixing tank 18 and rinsing tanks 22 and 24, which are adapted for supplying water by cascading. By compensating the above-described sum into the rinsing tank 24, the overflowing water is compensated into the rinsing tank 22 and the water stored within the rinsing tank 22 is compensated to the fixing tank 18 by the pump 72 and the line 73 while the overflowing treating solution from the fixing tank 18 is replenished to the bleaching/fixing tank 16. Thus all four tanks can serve to replenish water loss caused by evaporation.

Incidentally, although the above-described embodiment refers to a case where water is supplied to the stabilizing tank 26, as for the stabilizing tank 26, water does not always have to be supplied, but the replenishing solution itself for the stabilizing tank 26 may be compensated.

TABLE 3

| | | N1(ml/d) | N2(ml/d) | NS(ml/d) | N4(ml/d) |
|---|---|---|---|---|---|
| TS = 7 | DRY | 182.2 | 95.6 | 378.62 | 153.16 |
| TD = 1 | STAND-ARD | 159.4 | 81.4 | 330.4 | 136.3 |
| TO = 16 | WET | 136.6 | 67.2 | 282.18 | 119.42 |
| TS = 11 | DRY | 202.2 | 107.6 | 442.54 | 184.14 |
| TD = 1 | STAND-ARD | 184.2 | 96.2 | 403.6 | 169.9 |
| TO = 12 | WET | 166.2 | 84.8 | 364.66 | 155.66 |
| TS = 4 | DRY | 210.4 | 128 | 488.72 | 231.84 |
| TD = 4 | STAND-ARD | 176.8 | 104.8 | 407.2 | 196 |
| TO = 16 | WET | 143.2 | 81.6 | 325.68 | 160.16 |
| TS = 8 | DRY | 230.4 | 140 | 552.64 | 262.8 |
| TD = 4 | STAND-ARD | 201.6 | 119.6 | 480.4 | 229.6 |
| TO = 12 | WET | 172.6 | 99.2 | 408.16 | 196.4 |
| TS = 8 | DRY | 345.6 | 203.6 | 758.8 | 308.8 |
| TD = 4 | STAND-ARD | 403.2 | 240.8 | 886.72 | 357.84 |
| TO = 36 | WET | 288 | 166.4 | 630.83 | 259.76 |
| TS = 8 | DRY | 489.6 | 287.6 | 1037.2 | 388 |
| TD = 4 | STAND-ARD | 576 | 341.6 | 1220.8 | 452.88 |
| TO = 60 | WET | 403.2 | 233.6 | 853.6 | 323.12 |

Figure 6:
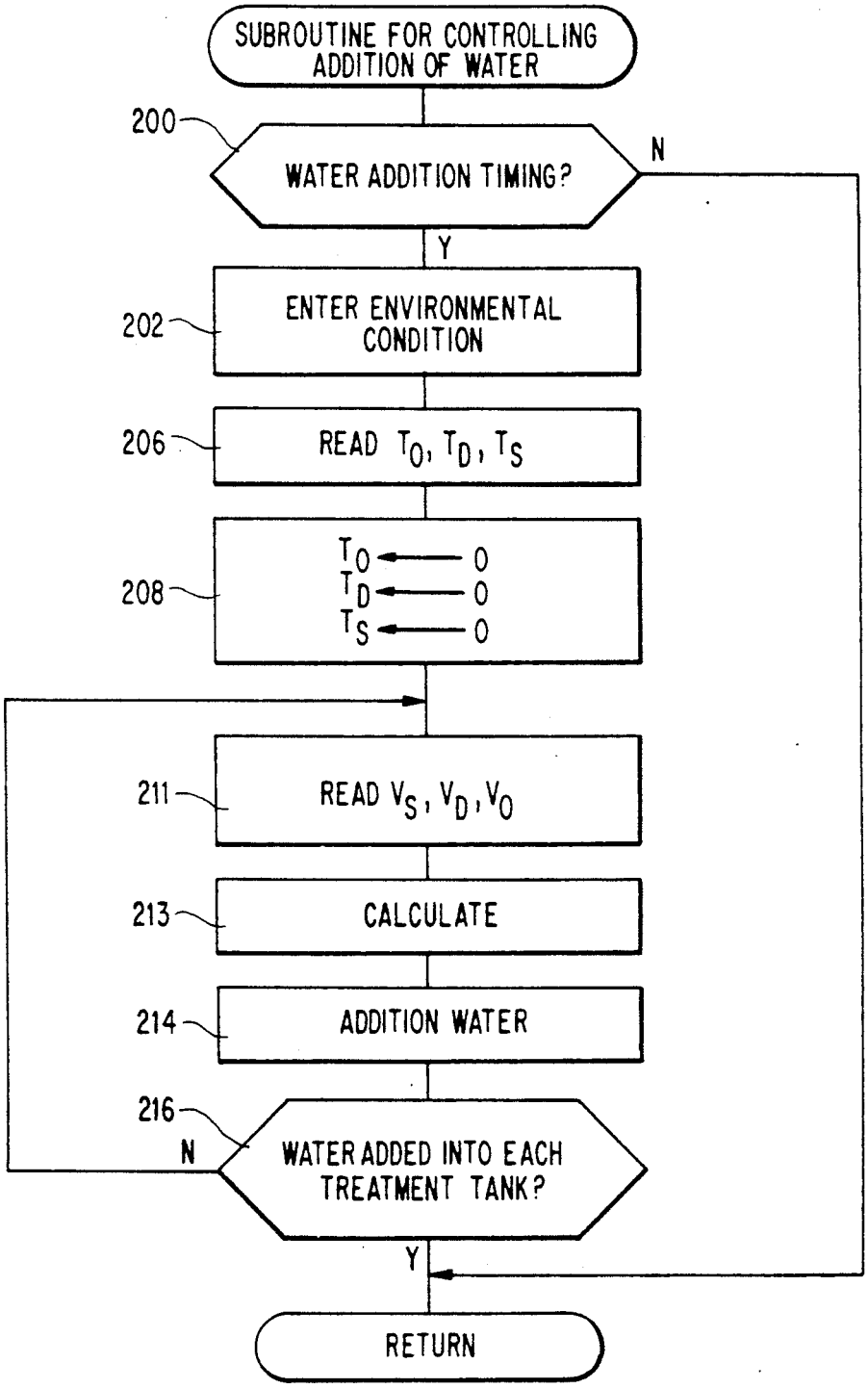
FIG. 6 is a flowchart illustrating a subroutine for controlling the addition of water according to a third embodiment.

TS: stand-by time (hours)
TD: running time (hours)
TD: shutdown time (hours)
DRY: low humidity (dry) condition
STANDARD: standard condition
WET: high humidity condition
N1: developing tank
N2: bleaching tank
NS: rinsing tank In FIG. 6, a subroutine for controlling the addition of water according to a third embodiment of the invention is illustrated. Incidentally, an automatic developing apparatus according to this embodiment is illustrated in FIG. 1. In place of Table 1 used in the first and second embodiments, the present embodiment relates to one using Table 2, (a). Therefore, portions similar to those of FIG. 3 are designated with like signs for omission of further description.

In this embodiment, as shown in Table 2 (a), the evaporating speed for each treating tank 10 is measured in the stand-by condition, running condition and shutdown condition, respectively, and is measured under five environmental conditions, respectively. Therefore, $f_i$ is not used. In step 211, the evaporation losses $V_S$, $V_D$ and $V_O$ per unit of time, each of which correspond to the environmental condition entered in step 202, are read out for each treating tank. In step 213, the amount of water to be compensated is evaluated for each treating tank by assigning it into the following second formula along with the time for each working condition.

$$\text{mount of water to be compensated} = TS \times VS + TO \times VO \quad (2)$$

Figure 7:
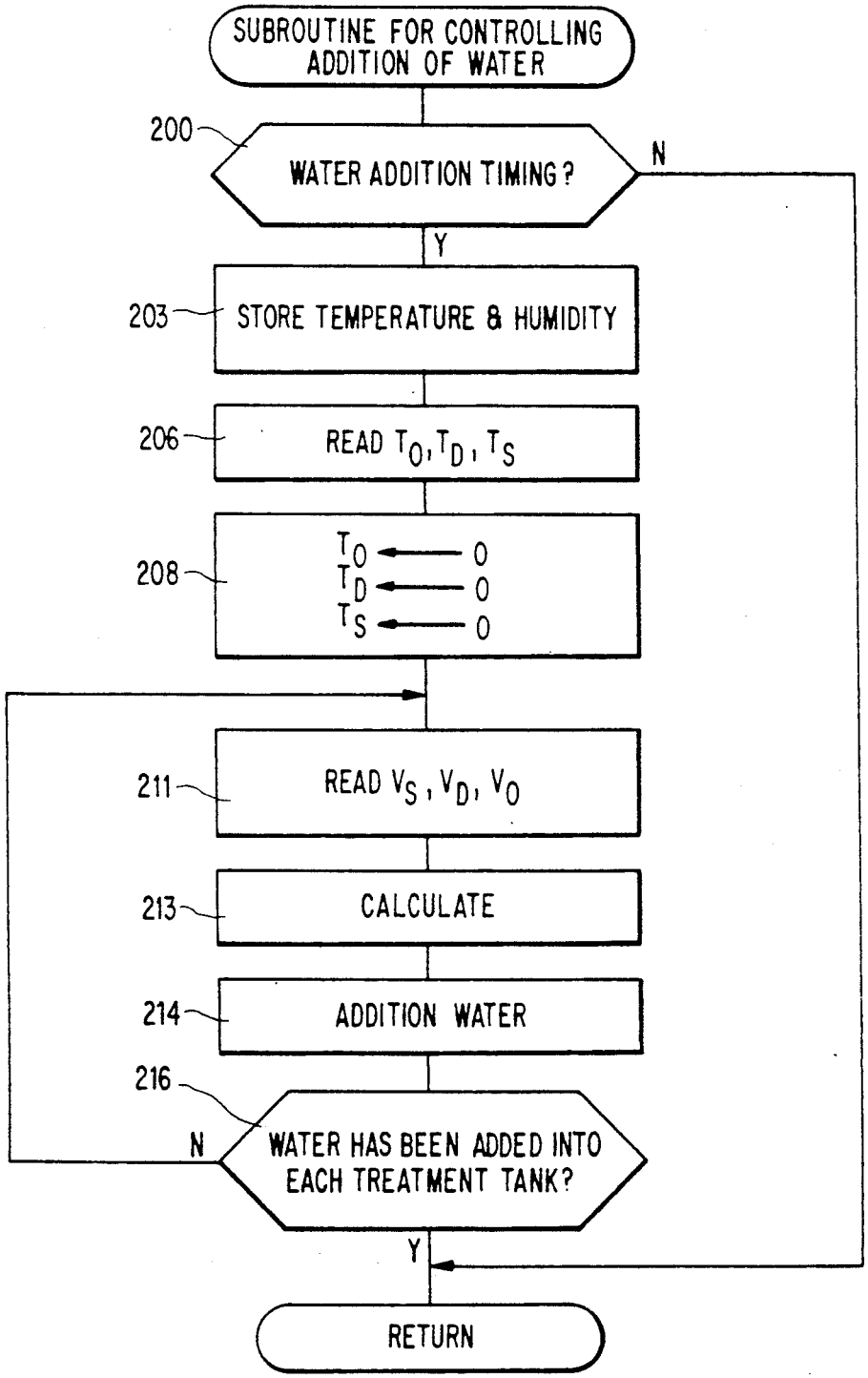
FIG. 7 is a flowchart illustrating a subroutine for controlling the addition of water according to a fourth embodiment.

In FIG. 7, a subroutine for controlling the addition of water according to a fourth embodiment of the invention is shown. In addition, an automatic developing apparatus according to this embodiment is shown in FIG. 4. In this embodiment, in place of entering the environmental conditions in step 202 of the subroutine of FIG. 6 (third embodiment), the temperature and the humidity are entered in step 203 of FIG. 7. Therefore, since all the steps therein are the same as in the third embodiment except for step 202, their description is omitted.

What is claimed is:

1. Method of compensating water into each of a plurality of treating tanks of an apparatus for treating a photosensitive material comprising the steps of:

a) previously evaluating evaporation loss from said treating tanks per unit of time depending on environmental conditions surrounding the apparatus;

b) determining said environmental conditions prevailing at the place where said apparatus is provided;

c) calculating an amount of water to be compensated into the treating tank based on said determined environmental conditions and evaporation loss per unit of time; and d) supplying an amount of water corresponding to said calculated amount into said treating tanks, wherein said evaporation loss from the treating tank per unit of time is determined depending on the working conditions of the apparatus, and further wherein said working conditions comprise three types of conditions: a stand-by condition, in which electric power is being supplied and the photosensitive material is ready to be fed into the treating tank, a shutdown condition, in which the apparatus is stopped, and a running condition, in which the photosensitive material is being treated.

2. Method of compensating water as defined in claim 1 wherein the evaporation loss from the treating tanks per unit of time, depending on said environmental conditions, is determined for each treating tank and an amount of water to be compensated is calculated for each treating tank, and an amount of water corresponding to the calculated amount is supplied to each treating tank.

3. Method of compensating water as defined in claim 1 wherein said environmental conditions are determined based on the humidity and temperature prevailing at the place where the apparatus is provided.

4. Method of compensating water as defined in claim 1 wherein the amount of water to be compensated is calculated in accordance with the following formula:

$$\text{amount of water to be compensated} = TS \times VS + TD \times VD + TO \times VO$$

where:

TS: stand-by time

TD: running time

TO: shutdown time

VS: evaporation loss per unit of time at the time of stand-by condition according to the environmental conditions VD: evaporation loss per unit of time at the time of running condition according to the environmental conditions VO: evaporation loss per unit of time during the time of shut down according to the environmental conditions.

5. Method of compensating water into each of a plurality of treating tanks of an apparatus for treating a photosensitive material comprising the steps of:

a) previously evaluating evaporation loss from said treating tanks per unit of time depending on environmental conditions surrounding the apparatus;

b) determining said environmental conditions prevailing at the place where said apparatus is provided;

c) calculating an amount of water to be compensated into the treating tank based on said determined environmental conditions and evaporation loss per unit of time; and d) supplying an amount of water corresponding to said calculated amount into said treating tanks, wherein said environmental conditions are determined based on information manually entered.

6. Method of compensating water into each of a plurality of treating tanks of an apparatus for treating photosensitive material comprising the steps of:

a) previously evaluating evaporation loss from said treating tanks per unit of time according to working conditions;

b) determining the working conditions and working condition time for the apparatus;

c) calculating an amount of water to be compensated into the treating tanks based on said determined evaporation loss per unit of time and said working condition time of the apparatus; and d) supplying an amount of water corresponding to said calculated amount into the treating tanks, wherein said working conditions comprise three types of conditions: a stand-by condition, in which electric power is being supplied and the photosensitive material is ready to be fed into the apparatus, a shutdown condition, in which the apparatus is stopped, and a running condition, in which the photosensitive material is being treated.

7. Method of compensating water as defined in claim 6 wherein said evaporation loss from the treating tanks per unit of time according to said working condition is determined for each treating tank and an amount of water to be compensated is calculated for each treating tank to supply an amount of water corresponding to said calculated amount for each treating tank.

8. Method of compensating water into each of a plurality of treating tanks of an apparatus for treating photosensitive material comprising the steps of:

a) previously evaluating a correction factor for correcting the amount of water to be compensated according to evaporation loss from the treating tank per unit of time according to the working conditions and the environmental conditions prevailing at the place where the apparatus is provided;

b) determining the environmental conditions prevailing at the place where the apparatus is provided, working conditions and working condition time of the apparatus;

c) calculating an amount of water to be compensated into the treating tank based on said evaporation loss from said treating tank per unit of time according to the working conditions of the apparatus, the correction factor for correcting said amount of water according to said determined environmental conditions and said working condition time; and d) supplying an amount of water corresponding to said calculated amount into the treating tank, wherein said working conditions comprise three types of conditions: a stand-by condition, in which electric power is being supplied to the apparatus and the photosensitive material is set to be fed into the apparatus, a shutdown condition, in which the apparatus is stopped, and a running condition, in which the photosensitive material is being treated.

9. Method of compensating water as defined in claim 8 wherein said evaporation loss from the treating tank per unit of time according to said working condition is determined for each treating tank and an amount of water to be compensated is calculated for each treating tank to supply an amount of water corresponding to the calculated amount.

10. Method of compensating water as defined in claim 8 wherein said correction factor for correcting the amount of water according to the environmental condition prevailing at the place where the apparatus is provided is determined according to a standard condition, a low humidity condition, which is lower in humidity than the standard, and a high humidity condition, which is higher in humidity than the standard.

11. Method of compensating water as defined in claim 8 wherein said environmental conditions are determined based on the humidity prevailing at the place where the apparatus is provided or the information about the detected temperature and humidity.

12. Method of compensating water as defined in claim 8 wherein the amount of water to be compensated is calculated in accordance with the following formula:

$$\text{amount of water to be compensated} = TS \times VS + (TD \times VD + TD \times VO) \times fi \times \alpha$$

where:

TS: stand-by time

TD: running time

TO: shutdown time

VS: evaporation loss per unit of time at the time of stand-by

VD: evaporation loss per unit of time at the time of running

VO: evaporation loss per unit of time at the time of shutdown fi: correction factor (i=0, 1, 2) where i=0 refers to the standard condition, i=1 to the low humidity condition and i=2 to the high condition α: corrected amount.

13. Method of compensating water into each of a plurality of treating tanks of an apparatus for treating photosensitive material comprising the steps of:

a) previously evaluating a correction factor for correcting the amount of water to be compensated according to evaporation loss from the treating tank per unit of time according to the working conditions and the environmental conditions prevailing at the place where the apparatus is provided;

b) determining the environmental conditions prevailing at the place where the apparatus is provided, working conditions and working condition time of the apparatus;

c) calculating an amount of water to be compensated into the treating tank based on said evaporation loss from said treating tank per unit of time according to the working conditions of the apparatus, the correction factor for correcting said amount of water according to said determined environmental conditions and said working condition time; and d) supplying an amount of water corresponding to said calculated amount into the treating tank, wherein said environmental conditions are determined based on information manually entered.

* * * * *